US007066370B2

(12) United States Patent
Ebihara

(10) Patent No.: US 7,066,370 B2
(45) Date of Patent: Jun. 27, 2006

(54) CASSETTE FOR STAPLER

(75) Inventor: Yoshiyuki Ebihara, Tokyo (JP)

(73) Assignees: E-Top Corporation, Tokyo (JP); Sato Kensetsu Kogyo Co., LTD, Tokyo (JP)

( * ) Notice: Subject to any disclaimer, the term of this patent is extended or adjusted under 35 U.S.C. 154(b) by 30 days.

(21) Appl. No.: 10/516,125

(22) PCT Filed: May 28, 2003

(86) PCT No.: PCT/JP03/06708

§ 371 (c)(1),
(2), (4) Date: Nov. 29, 2004

(87) PCT Pub. No.: WO03/099521

PCT Pub. Date: Dec. 4, 2003

(65) Prior Publication Data

US 2005/0173488 A1 Aug. 11, 2005

(30) Foreign Application Priority Data

May 28, 2002 (JP) ..... 2002-154343

(51) Int. Cl.
*B25C 5/02* (2006.01)

(52) U.S. Cl. ..... 227/119; 227/120; 227/134

(58) Field of Classification Search ..... 227/120, 227/109, 134, 119, 131; 206/340; 221/279, 221/198

See application file for complete search history.

(56) References Cited

U.S. PATENT DOCUMENTS

| | | | | | |
|---|---|---|---|---|---|
| 3,115,991 | A | * | 12/1963 | Carew et al. | 221/198 |
| 4,546,909 | A | * | 10/1985 | Ebihara | 227/120 |
| 4,556,161 | A | * | 12/1985 | Oide | 227/83 |
| 4,687,098 | A | * | 8/1987 | Ebihara | 206/340 |
| 4,706,865 | A | * | 11/1987 | Ebihara | 227/110 |
| 4,717,063 | A | * | 1/1988 | Ebihara | 227/155 |
| 5,335,839 | A | * | 8/1994 | Fealey | 227/132 |
| 5,364,000 | A | * | 11/1994 | Fealey | 227/124 |
| 5,816,470 | A | * | 10/1998 | Plato et al. | 227/132 |
| 6,152,347 | A | * | 11/2000 | Wilson et al. | 227/134 |

* cited by examiner

*Primary Examiner*—Scott A. Smith
(74) *Attorney, Agent, or Firm*—Grimes & Battersby, LLP

(57) ABSTRACT

A cassette for stapler capable of storing staples with different lengths of needle legs and capable of being manufactured at a low cost, comprising a cassette body formed slender with a channel shaped cross section and having a staple extrusion groove provided at the tip thereof, a staple holder longitudinally fitted to the cassette body to hold the large number of staples, a feeder for moving the staples pressingly toward the tip thereof, a spring for energizing the feeder, and a guide rod for guiding the movement of the feeder, wherein a guide wall capable of storing the staples with different lengths of needles is provided in the staple holder.

3 Claims, 10 Drawing Sheets

18a
18b,18c
18b,18c
13a
18
13
11
17
18a
21b
21a
13a
16b
16
16c
15a
13
21a
18
15
21
13
21a
5
20
4
3
12
11
13
13
21
12

13
13a
11

13
8
7a
13b 13
8

13
A
A
7a
13b
13b
11

13
13b
13b
A-A 13
11

15
15a
15b
15c
15d 13
13a 13a
13
21

13

15
15a
15c
15b
15d
15d 15
15d
15c
15c
14
15b
15c
15a 15
15a
15d
15c

CASSETTE FOR STAPLER

TECHNICAL FIELD

The present invention relates to a cassette for a stapler, which can be stored with staples having needle legs of different lengths.

BACKGROUND ART

In the prior art, a dedicated stapler cassette has been manufactured for each of staples having needle legs of different lengths. This stapler is loaded for different applications with stapler cassettes for different needle leg lengths.

A stapler cassette has been proposed by us in JP-KOKAI (unexamined patent publication)-HEI07-96475. In a stapler cassette 31, as shown in FIG. 10, a frame 32 is provided at its leading end with a cap 33, and accommodates a guide 34 loaded with staples 35. In the guide 34, there is fitted a pusher head 37, which is attached to the leading end of a pusher spring 36 so as to slide the rear end of the staples 35 back and forth. The staples 35 are pushed at all times toward the cap 33 by the pusher head 37. Numeral 38 designates a rear end cap of the pusher spring 36.

The staples 35 stored in the stapler cassette are extruded down by the downward push of the cap 33.

PROBLEMS THAT THE INVENTION IS TO SOLVE

However, in the stapler cassette of the prior art the cassettes adapted especially for the lengths of needle legs of staples have to be manufactured. This increases the kinds of cassettes suited for the lengths of needle legs. As a result, it needs high cost to manufacture the cassettes and is difficult to store and manage the same.

Moreover, the cassettes of the prior art are insufficient for storing the staples and are encountered by the phenomenon of staple clogging and by the deficient stability of products.

Therefore, the invention has been conceived in view of the problems of the prior art thus far described, and has an object to provide a cassette, which can store the staples having the different needle leg lengths without increasing the kinds of the cassette and which can be manufactured at a low cost.

DISCLOSURE OF THE INVENTION

In order to achieve the above-specified object, according to Claim 1 of the invention, there is provided a cassette for a stapler stored with a multiplicity of juxtaposed staples each having a pair of opposed needle legs, comprising: a cassette body formed slender with a channel-shaped cross section and having a staple guide slit opened in the upper face thereof, through which the blade for extruding staples stored on the upper face of the leading end portion is moved up and down; a staple holder fitted in the channel-shaped open face of the cassette body and having a staple extrusion groove opened below the blade guide slit of the cassette body and at a position to confront the blade guide slit and having a pair of erected guide walls supporting the needle legs; a feeder pushing the staples toward the staple extrusion groove of the staple holder; a spring for urging the feeder toward the stapler extrusion groove of the staple holder; and a guide rod for guiding the movement of the feeder. The cassette is characterized in that the staples are extruded, while being pushed by the feeder, is extruded from the staple extrusion groove by the up-and-down movements of the blade.

In Claim 1, the stapler cassette according to Claim 2 is characterized in that a pair of guide walls for supporting the leading ends of the needle legs are erected along the side edge portions of the staple holder.

In Claim 1, the stapler cassette according to Claim 3 is characterized in that retaining projections for fixing the loading position of the cassette stored with the staples are formed on the upper face of the rear portion of the cassette body and/or on the lower face of the rear portion of the staple holder.

In Claim 1, the stapler cassette according to Claim 4 is characterized in that the cassette is made of a hard synthetic resin.

According to Claims 1 and 2, the stapler cassette of the invention is constructed such that the staple holder is separately incorporated into the cassette body. By incorporating the staple holder provided with the guide walls having a height corresponding to the length of the needle legs, therefore, the cassette can be efficiently used without any change in its entirety while meeting the demand for the staples of different needle leg lengths.

Moreover, the paired confronting guide walls act as rails to mount the needle legs of the staples thereon. Therefore, the staples are carried on the ceiling portion so that they are not encountered by any rattling. Moreover, the guide walls have no clearance from the ceiling portion of the staples so that they guide the staples to the staple extrusion groove. Therefore, neither rattling nor clogging occurs in the staples being carried.

According to Claim 3, the retaining projections are formed on the upper face of the rear portion of the cassette body and/or on the lower face of the rear portion of the staple holder. As a result, the cassette can be loaded no matter whether the stapler-side retained portion might be positioned on the upper or lower side.

According to Claim 4, the cassette is made of plastics at a low cost so that it can be disposed of.

EXPLANATION OF LETTERS OR NUMERALS

Figure 1A:
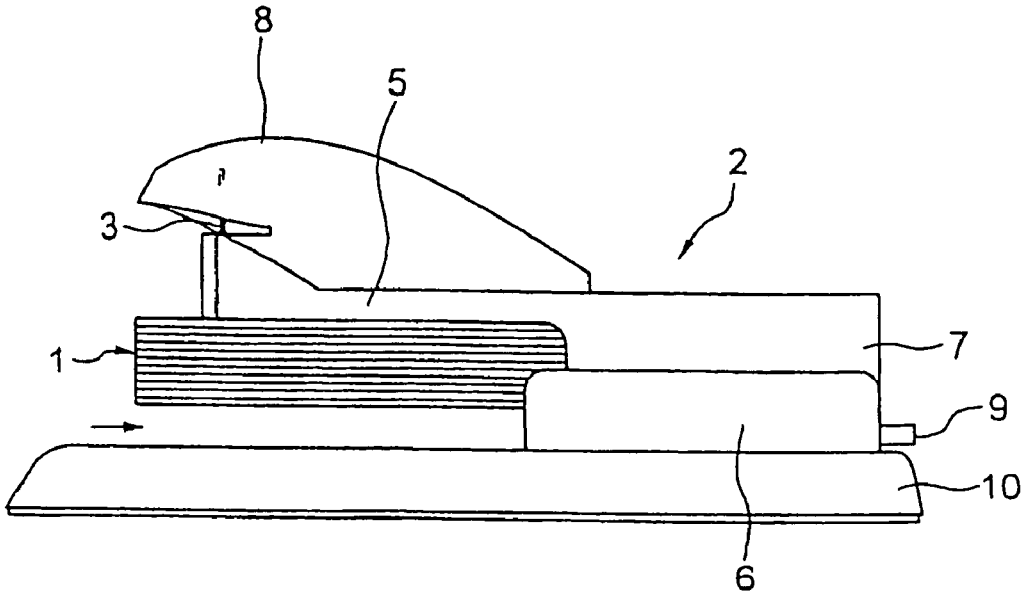
In FIG. 1 presenting side elevations showing the state, in which an embodiment of the invention is inserted into a stapler, (a) is a side elevation showing the inserted state, and (b) is a side elevation showing the moved state of staples.

1. Cassette
2. Stapler
3. Blade
4. Staple
5. Frame
6. Guide portion
7. Cover
8. Handle
9. Lever
10. Base
11. Staple guide slit
12. Staple extrusion groove
13. Cassette body
14. Guide wall
15. Staple holder
16. Feeder
17. Spring
18. Guide rod

BEST MODE FOR CARRYING OUT THE INVENTION

Figure 1B:
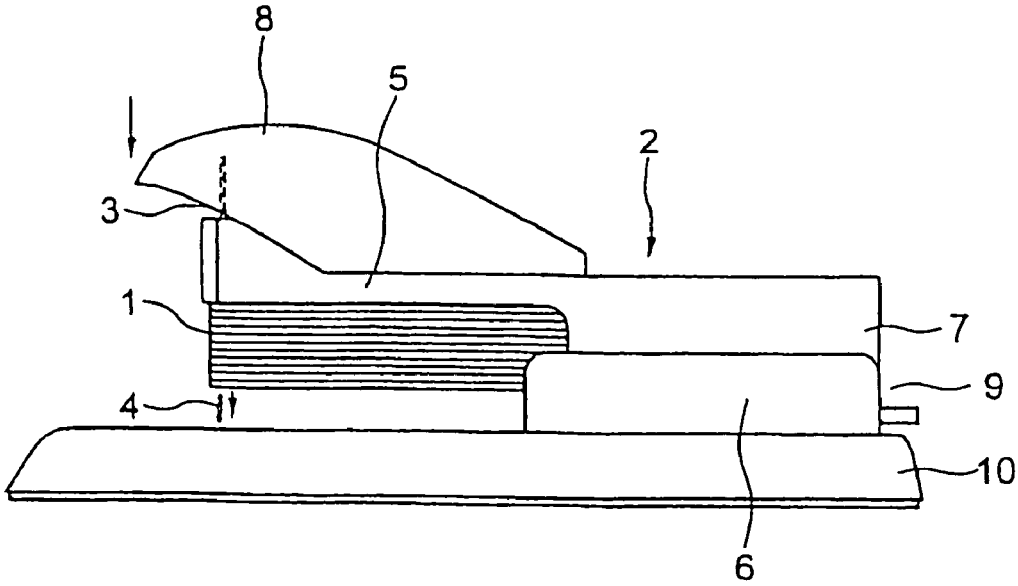
Figures 2A, 2B, 2C, 2D:
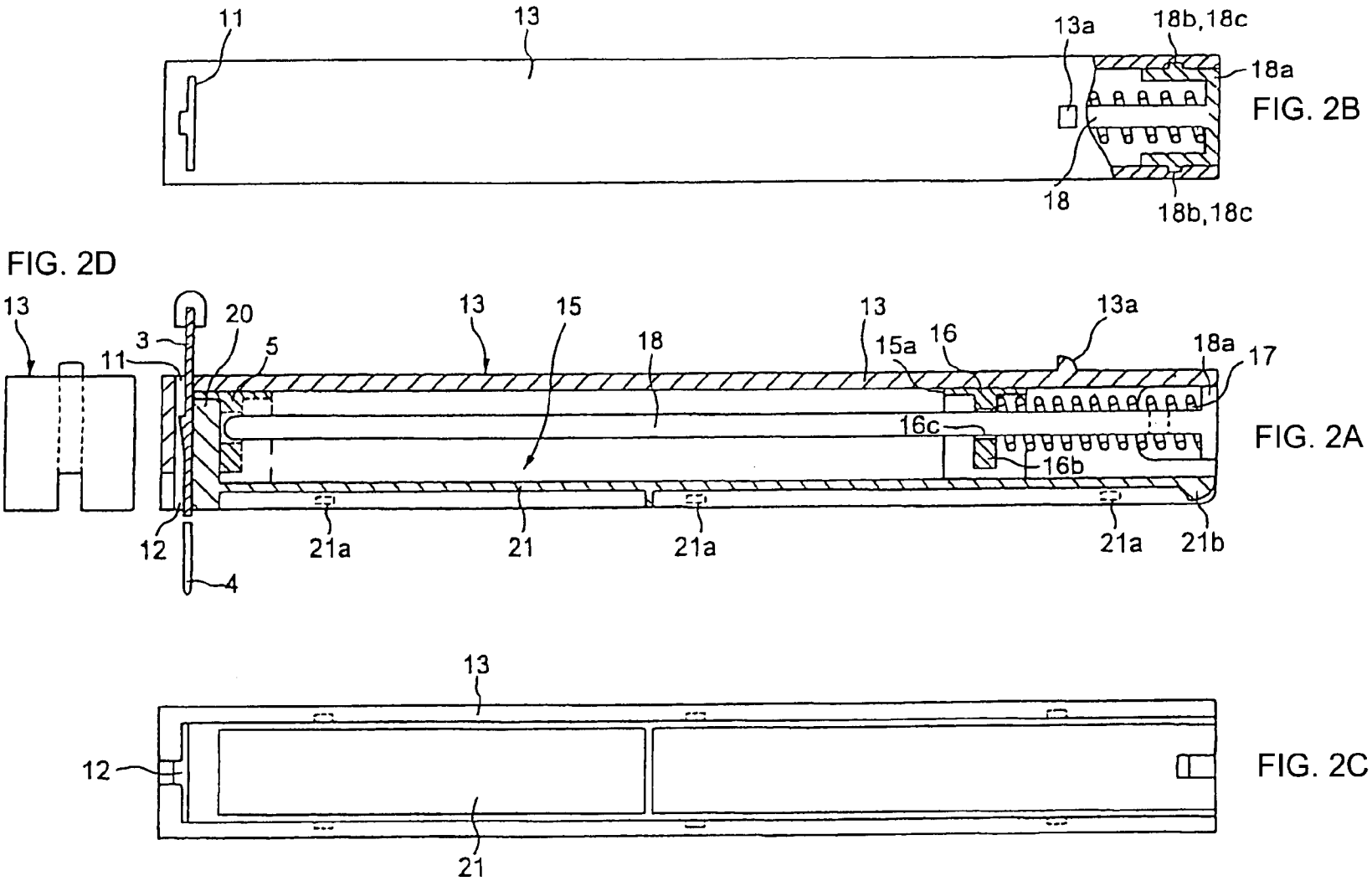
In FIG. 2 relating to the first embodiment of the invention: (a) is a sectional view of showing the side of a cassette; (b) is a plan view of the same; (c) is a back view of the same; and (d) is an end view of the same.
Figures 3A, 3B, 3C, 3D, 3E, 3F:
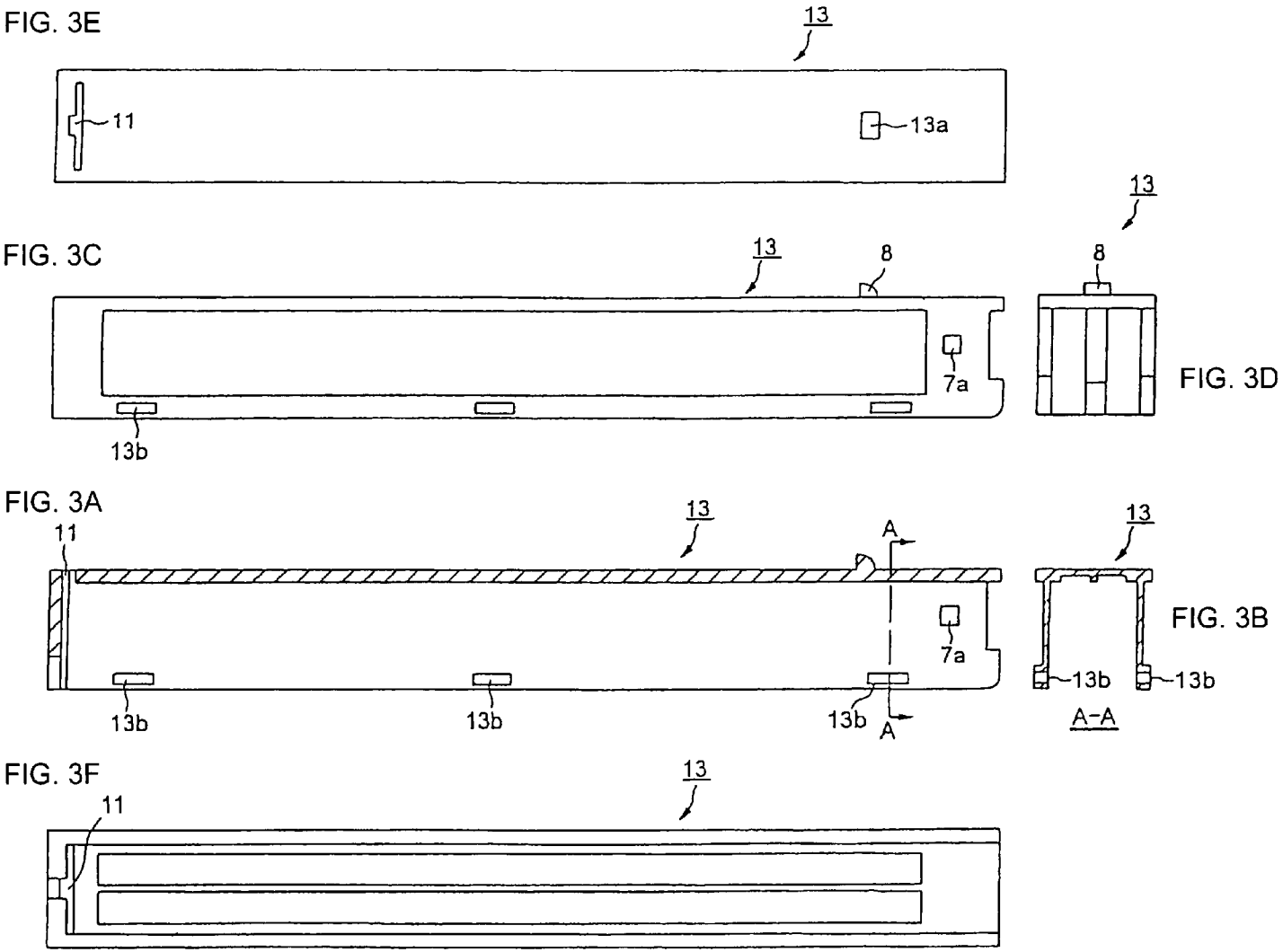
In FIG. 3 presenting sectional views of a cassette body of FIG. 2: (a) is a sectional view showing the side face of the cassette body; (b) is a sectional view taken along arrows A—A of the same; (c) is a side elevation of the same; (d) is an end view of the same; (e) is a plan view of the same; and (f) is a bottom view of the same.
Figures 4A, 4B, 4C:
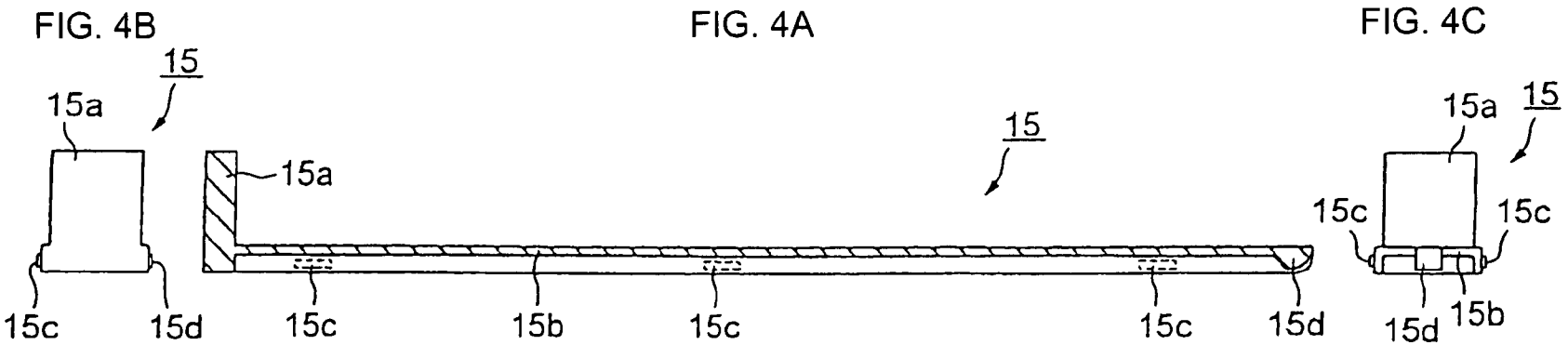
In FIG. 4 presenting sectional views showing the side face of the cassette body of FIG. 2, (a) to (d) are a section and end views showing the section of a staple holder having no guide wall.
Figures 5A, 5B, 5C:
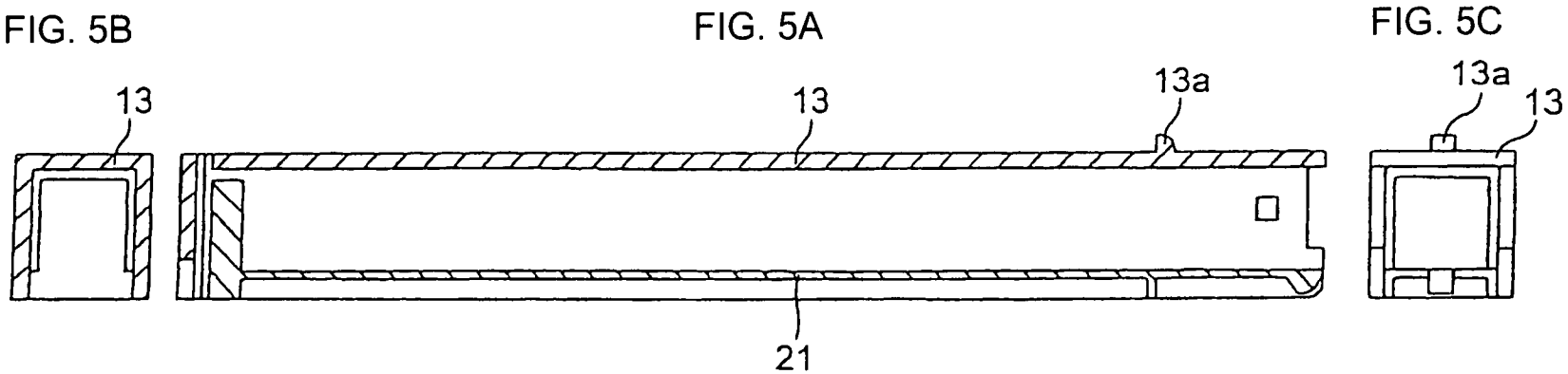
In FIG. 5 presenting sectional views showing the cassette body and the staple holder of FIG. 2, (a) to (c) are sectional views and an end view, respectively.
Figures 6A, 6B, 6C:
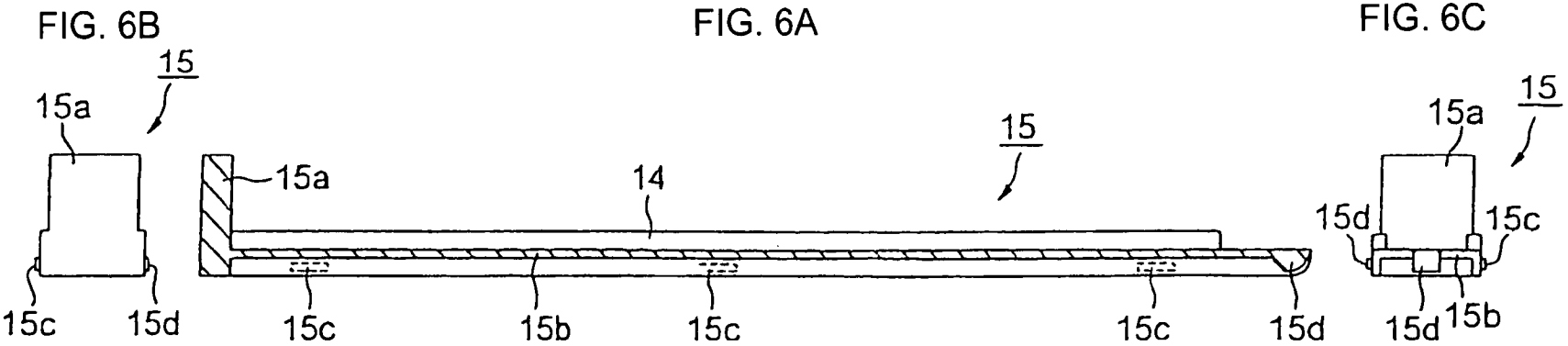
In FIG. 6 relating to a second embodiment of the invention, (a) to (c) are a sectional view and end views of a staple holder having guide walls with different heights.
Figures 7A, 7B, 7C:
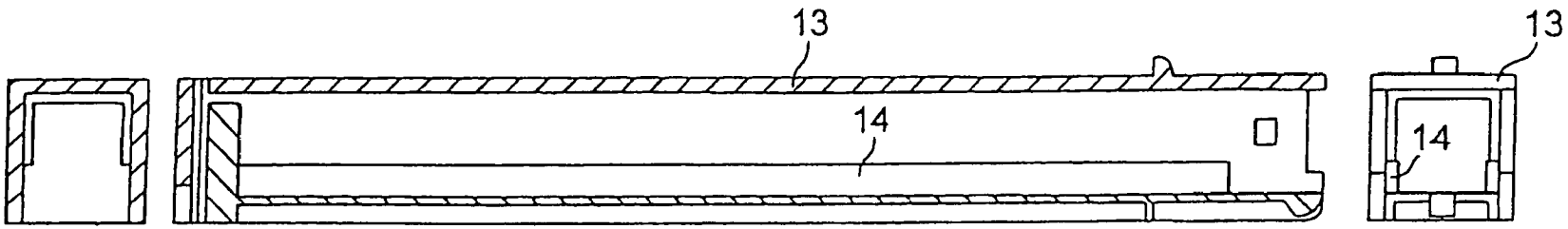
In FIG. 7 presenting sectional views showing the side faces of the cassette body of FIG. 6, (a) to (c) are sectional views and an end view showing the sides of the staple holder having the guide walls formed.
Figure 8B:
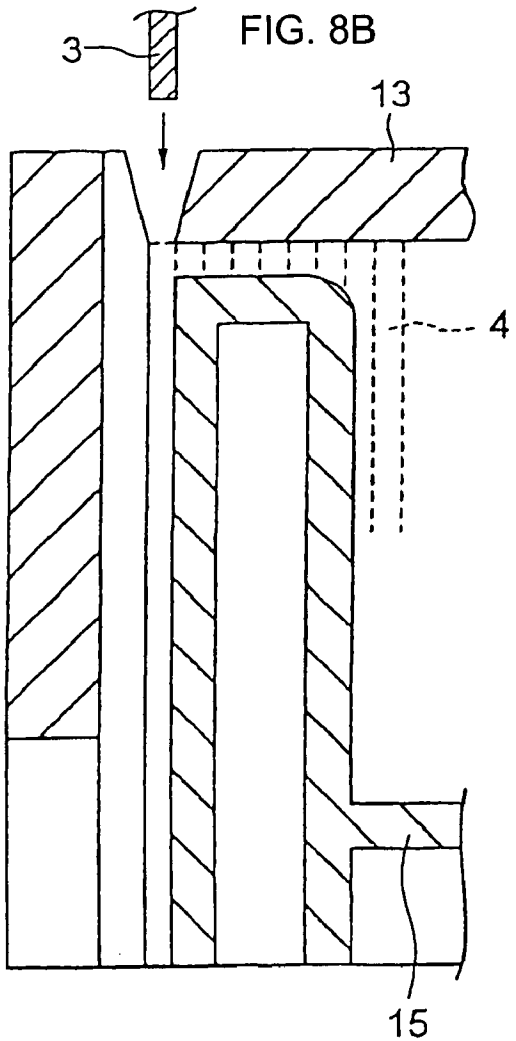
In FIG. 8 relating to the first embodiment shown in FIG. 2, (a) is an explanatory sectional view showing the side face, on which the staple holder in the state having no guide wall is incorporated into the cassette body.
Figure 8A:
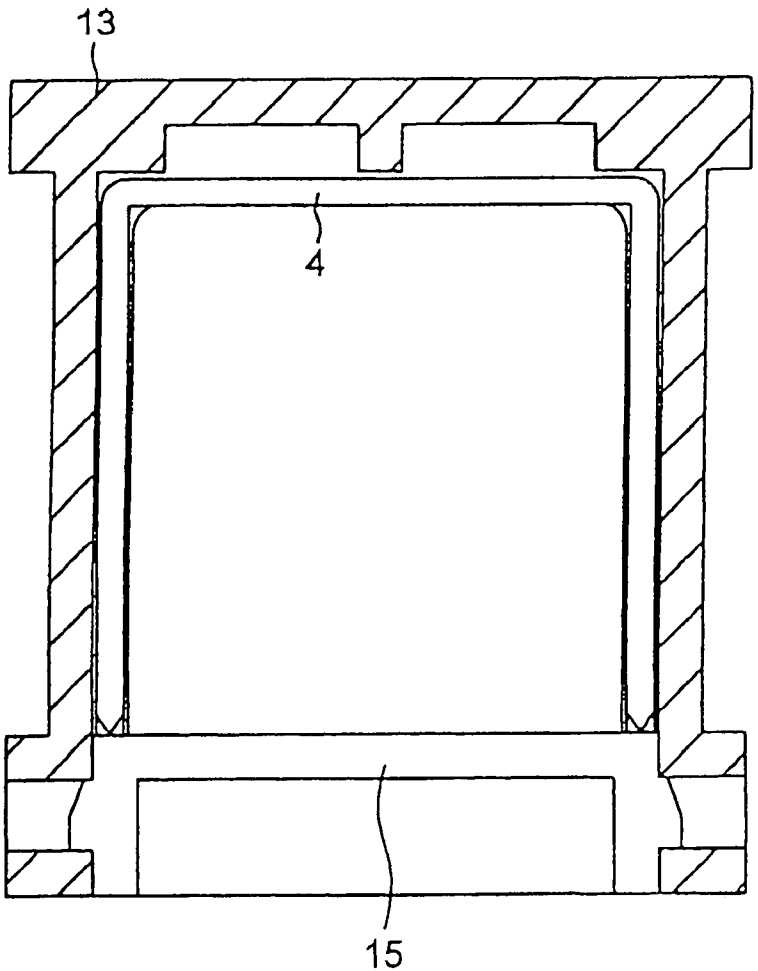
Figure 9B:
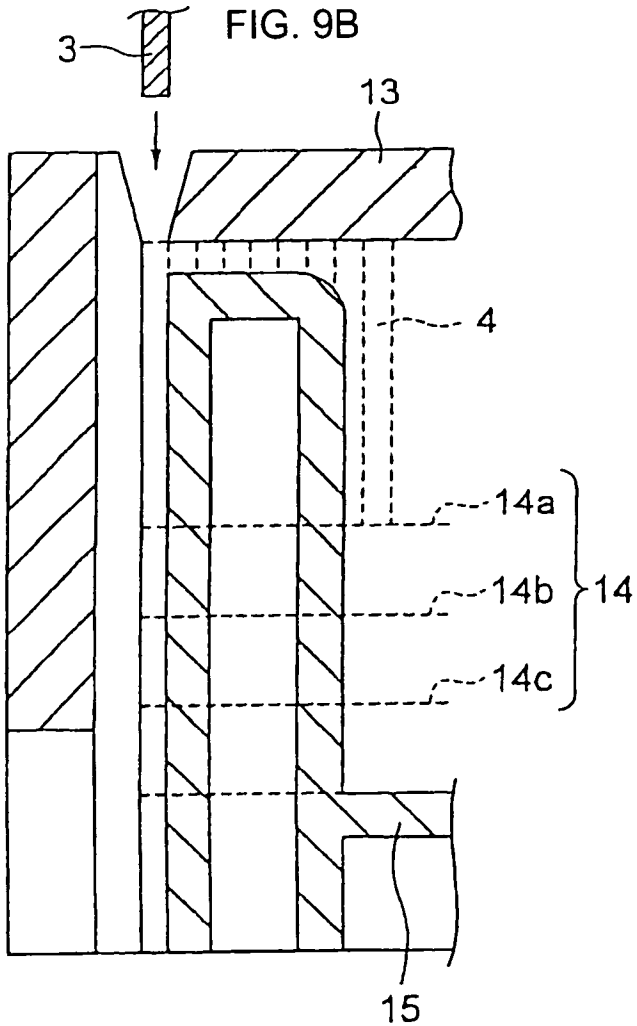
In FIG. 9 relating to the second embodiment shown in FIG. 6, (a) is an explanatory sectional view showing the side face, on which the staple holder in the state having no guide wall is incorporated into the cassette body.
Figure 9A:
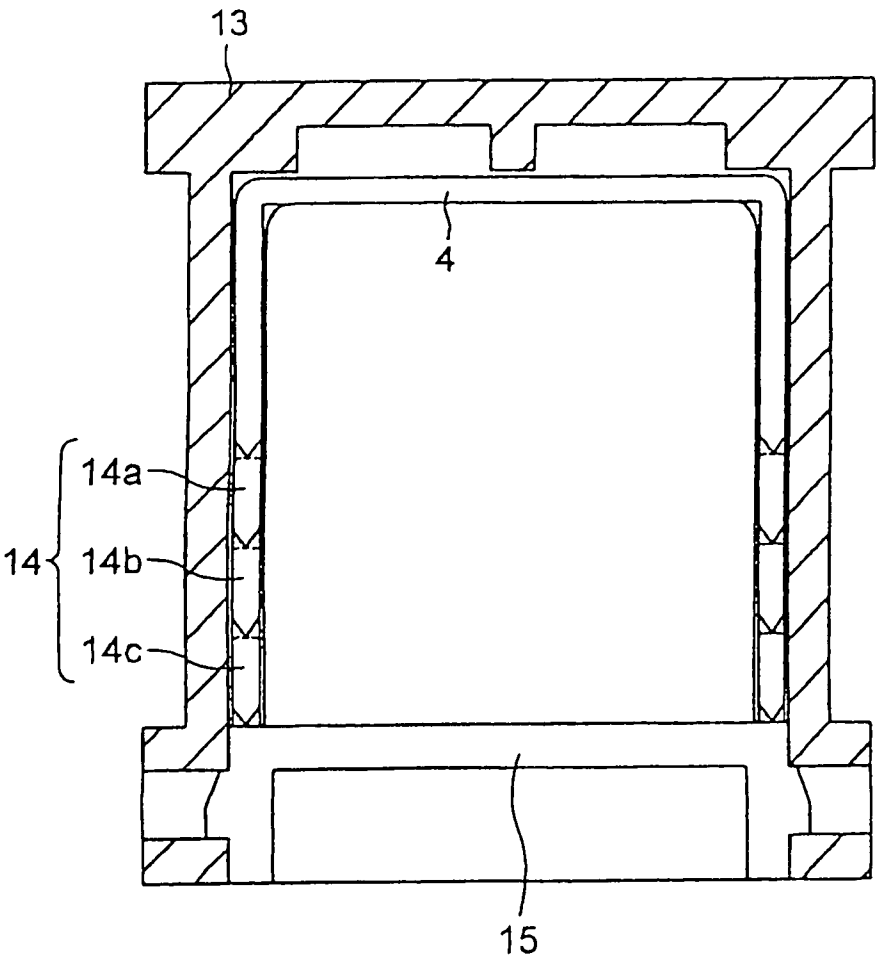
Figure 10A:
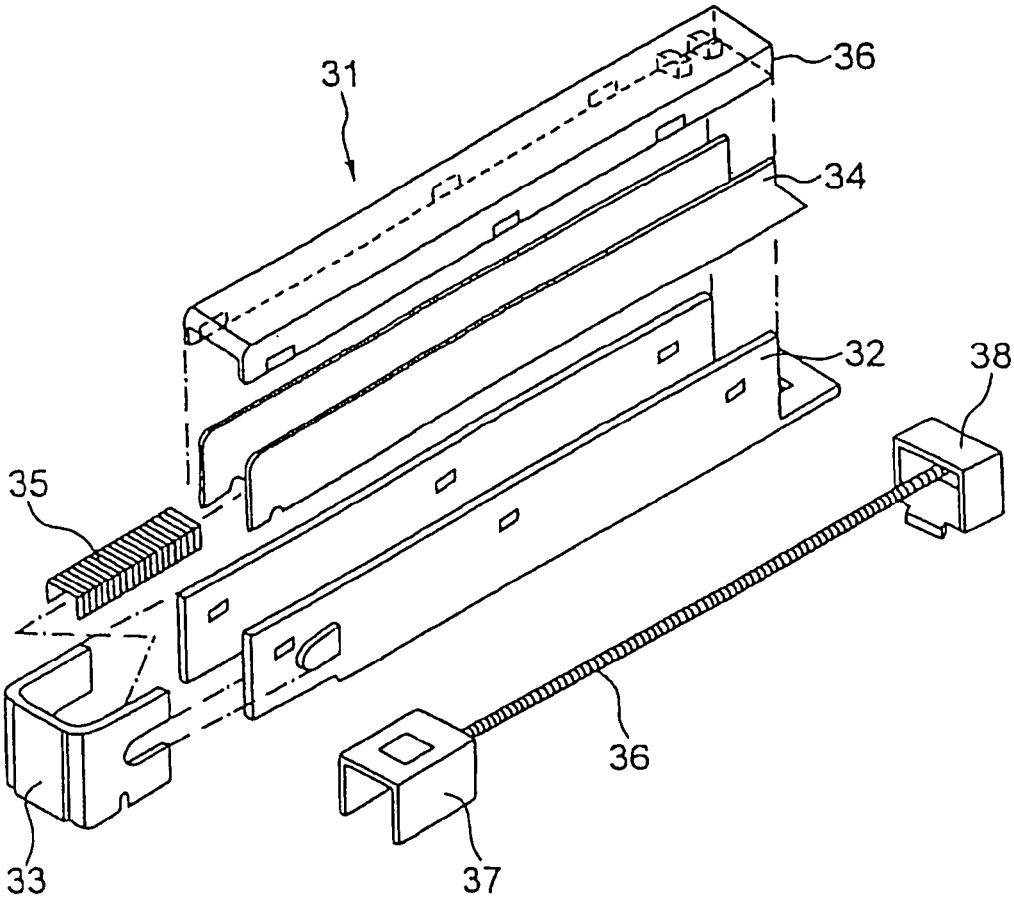
FIG. 10 presents an exploded perspective view of the stapler cassette of the prior art.
Figure 10B:
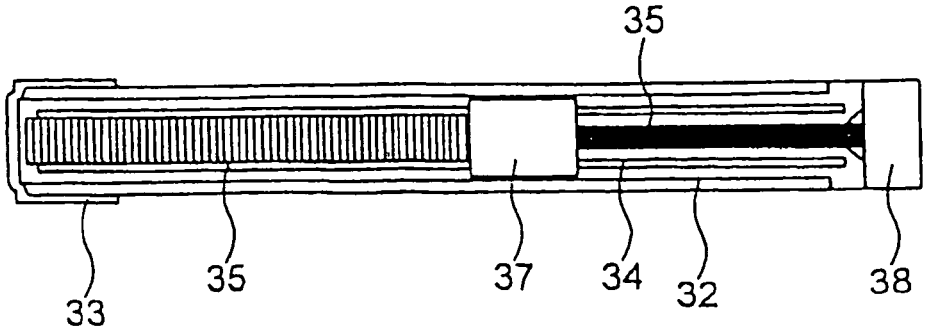

Embodiments of the invention will be described with reference to the accompanying drawings. FIG. 1 presents explanatory side elevations of the state, in which a cassette for a stapler according to the invention is inserted into a stapler body; FIG. 2 presents explanatory views showing the state, in which the stapler cassette according to a first embodiment of the invention is partially cut away; FIG. 3 presents explanatory views of a cassette body of FIG. 2; FIG. 4 also presents explanatory views of a staple holder shown in FIG. 2; FIG. 5 presents explanatory views of a staple holder shown in FIG. 2; FIG. 6 presents explanatory sections of a staple holder of a stapler cassette according to a second embodiment of the invention; FIG. 7 presents sections showing the sides, on which the staple holder having guide walls formed, as shown in FIG. 6, is incorporated into a cassette body; FIG. 8 presents enlarged sections showing the sides, on which staples shown in the first embodiment are loaded into the cassette; and FIG. 9 presents enlarged sections showing the sides, on which staples shown in the second embodiment are loaded into the cassette.

In a stapler cassette 1 according to the invention, as shown in FIG. 1 (a) and (b), staples 4 are loaded into a stapler body 2 of a cassette type stapler to be driven downward. When a blade 3 is moved up and down by operating a handle 8 after the cassette was inserted, the blade 3 pushes the staples 4 down to extrude them for use. The stapler body 2 is constructed to include integrally a frame 5 having an insertion hole for fitting the cassette 1, and a cover portion 7 supported by the frame 5 with a guide portion 6. The handle 8 is biased upward by bias means such as a spring to turn on the (not-shown) pin below the rear end of the cassette guide portion 6, and is disposed over the frame 5.

Here, reference numeral 9 designates a take-out lever disposed at the rear end of the cover 7 for extracting the cassette 1, and numeral 10 designates a base for the stapler body 2 of the cassette type stapler.

In the cassette 1 according to the invention, as shown in FIGS. 1 (a) and (b), when the handle 8 is depressed downward, the blade 3 is driven downward in association with the handle 8 so that it can shoot the staples 4 down onto the base 10. When the cassette 1 is to be exchanged, on the other hand, the lever 9 disposed at the back of the cover portion 7 is pushed downward, and the cassette 1 retained automatically by retaining projections is then released from the retention. The cassette 1 is projected forward so that it can be replaced.

As shown in FIG. 2 to FIG. 5, the cassette 1 is constructed to comprise: a cassette body 13 formed slender with a channel-shaped cross section and having a blade guide slit 11 opened in the upper face thereof, through which the blade 3 for extruding the staples 4 stored on the upper face of the leading end portion is moved up and down; a staple holder 15 fitted in the channel-shaped open face of the cassette body 13 and having a staple extrusion groove 12 opened below the blade guide slit 11 of the cassette body 13 and at a position to confront the staple guide slit 11; a feeder 16 pushing the staples 4 toward the staple extrusion groove 12 of the staple holder 15; a spring 17 for urging the feeder 16 toward the stapler extrusion groove 12 of the staple holder 15; and a guide rod 18 for guiding the movement of the feeder 16.

While the staples on the staple holder 15 being pushed by the feeder 16, according to the invention, the staplers 4 are pushed from the stapler extrusion groove 12 onto the base 10 by the vertical movements of the blade 3.

As shown in FIGS. 2 (a), (b), (c) and (d) and FIGS. 3 (a), (b), (c), (d), (e) and (f), the cassette body 13 is provided with a retaining projection 15*a* on the upper face of the rear portion for fixing the loading position when the cassette body 13 is loaded with the staples 4, and retaining holes 13*b* at three longitudinal portions on the two side faces for retaining the staple holder 15. Moreover, the cassette body 13 has an internal width set to accommodate the external width of the staples 4 slidably.

The staple holder 15 to be incorporated into the cassette body 13 is formed, as shown in FIG. 2(*a*), to include a guide head 20 having a width to guide the internal width of the staples 4 slidably, and a longitudinal base plate 21 leading to the rear end of the cassette body 13. The base plate 21 is provided at three longitudinal portions on its side faces with retaining projections 15*c* to be fitted in the sides of the cassette body 13.

The base plate 21 is further provided on the lower face of its rear end with a retaining projection 21*b* for fixing the loading position when the staple holder is loaded into the stapler 2.

The feeder 16 for pushing the staples 4 toward the leading end of the cassette 1 is provided on its front face with a pushing end face 16*a* which is shaped to correspond to the channel shape of the staples 4, and on its rear face with a spring seat 16*b* for receiving the abutment of the spring 17. In the center of the spring seat 16*b*, moreover, there is formed a hole 16*c*, through which the guide rod 18 can slidably move.

The guide rod 18 has a length from the leading end of the staple 4 on the side of the staple extrusion groove 12 to the rear end. The guide rod 18 has a fixing end portion 18*a* formed integrally with its rear end, and is fixed in retaining recesses 18*c* on the cassette body side, as shown in FIG. 1(*b*), through retaining projections 18*b* formed on the two sides of the fixing end portion 18*a*. The feeder 16 is mounted on the guide rod 18, and the spring 17 is interposed between the feeder 16 and the fixing end portion 18*a*.

As shown in FIG. 6 to FIG. 7, a cassette 1 according to a second embodiment is constructed to comprise: the cassette body 13 formed slender with the channel-shaped cross section and having the staple guide slit 11 opened in the upper face thereof, through which the blade 3 for extruding the staples 4 stored on the upper face of the leading end portion is moved up and down; the staple holder 15 fitted in the channel-shaped open face of the cassette body 13, having the staple extrusion groove 12 opened below the blade guide slit 11 of the cassette body 13 and at a position to confront the staple guide slit 11, and a pair of guide walls 14 erected along the side edges thereof for supporting the needle legs of the staples 4; the feeder 16 pushing the staples 4 on the guide walls 14 toward the staple extrusion groove 12 of the staple holder 15; the spring 17 for urging the feeder 16 toward the staple extrusion groove 12 of the staple holder 15; and the guide rod 18 for guiding the movement of the feeder 16.

While the staples being pushed by the feeder 16, according to the invention, the staples 4 on the guide walls 14 are pushed from the staple extrusion groove 12 onto the base 10 by the vertical movements of the blade 3.

This embodiment is characterized, as shown in FIG. 4 to FIG. 5, in that the guide walls 14 are so formed in the longitudinal direction on the two sides of the upper face of the base plate 21 as to have various heights corresponding to the needle lengths of the staples 4. As shown in FIG. 9, the guide walls 14 are divided into guide walls 14*a*, 14*b* and 14*c* corresponding to the staples 4 having the largest needle length. By changing the heights of the guide walls 14, therefore, the guide walls 14 can hold and accommodate the various staples 4 having the different needle lengths at a predetermined height.

The cassette thus constructed is wholly made of plastics excepting the spring for pushing the staples.

Here will be described the actions of the cassette.

In the cassette of the invention, as shown in FIG. 9, the staple holder 15, which is provided with the guide walls 14 having the heights corresponding to the needle lengths of the staples 4, is loaded into the cassette body 13 so that the edges of the staples 4 are held on the guide walls 14. Thus, the staples 4 are held at the predetermined height so that the staples 4 on the guide walls 14 take positions contacting with the upper face of the cassette body 13, as shown at (b) in FIG. 8 to FIG. 12. In this state, the relative positions between the upper end of the staples 4 and the lower end of the blade 3 become identical independently of the needle lengths so that the staples 4 can be shot under the identical conditions.

INDUSTRIAL APPLICABILITY

According to the invention, the staples are supported on the inner wall faces of the cassette body 13, and the rattling at the feeding time is prevented by the guide head 20. The blade can be smoothly actuated. Especially, the cassette can store the staples having the different needle leg lengths without increasing the kinds of the cassette and can be manufactured at a low cost.

Moreover, the staple holder having the guide walls with the heights corresponding to the needle lengths is separately incorporated into the cassette body so that the cassette can be wholly accommodated without any change even with the different needle lengths of the staples.

Moreover, the guide walls confronting each other act as rails to carry the staples on the ceiling portion so that they guide the staples without any rattling. Thus, the staples move without any rattling to cause no staple clogging.

Moreover, the retaining projections for fitting the staples are provided on the two upper and lower faces so that the cassette can be loaded no matter whether it might be directed to have the stapler-side retained portion on the upper or lower side.

Moreover, the cassette is made of plastics at the low cost so that it can be disposed of.

The invention claimed is:

1. A cassette for a stapler stored with a multiplicity of juxtaposed staples each having a pair of opposed needle legs, comprising:

a cassette body formed slender with a channel-shaped cross section and having a staple guide slit opened in the upper face thereof, through which the blade for extruding staples stored on the upper face of the leading end portion is moved up and down;

a staple holder fitted in the channel-shaped open face of said cassette body and including a staple extrusion groove opened below said staple guide slit of the cassette body and at a position to confront the staple guide slit, and a pair of guide walls erected for supporting said needle legs;

a feeder pushing said staples on said guide walls toward the staple extrusion groove of said staple holder;

a spring for urging said feeder toward the staple extrusion groove of said staple holder; and a guide rod for guiding the movement of said feeder, characterized in that said staples on said guide walls, while being pushed by said feeder, are extruded from said staple extrusion groove by the up-and-down movements of the blade.

2. A cassette for a stapler as set forth in claim 1, characterized in that retaining projections for fixing the loading position of the cassette stored with said staples are formed on the upper face of the rear portion of said cassette body and/or on the lower face of the rear portion of said staple holder.

3. A cassette for a stapler as set forth in claim 1, characterized in that said cassette is made of a hard synthetic resin.

* * * * *